United States Patent [19]

Rutkowski et al.

[11] 3,964,220

[45] June 22, 1976

[54] CONTROL JOINT WITH TEAR STRIP

[75] Inventors: Edward J. Rutkowski, Kenmore; Gerard T. Sowinski, Lancaster, both of N.Y.

[73] Assignee: National Gypsum Company, Buffalo, N.Y.

[22] Filed: Mar. 7, 1972

[21] Appl. No.: 232,598

Related U.S. Application Data

[60] Division of Ser. No. 28,906, April 15, 1970, abandoned, which is a continuation-in-part of Ser. No. 701,164, Jan. 29, 1968, abandoned.

[52] U.S. Cl. ..... 52/100; 52/256; 52/257; 52/364; 52/709; 52/710

[51] Int. Cl.[2] ..... E04B 1/41

[58] Field of Search ..... 52/100, 256, 364, 257, 52/709, 464, 98, 710, 468, 470, 403, 393, 396, 573, 309, 741; 287/20.92 W, 20.92 J; 94/18, 18.2

[56] References Cited

UNITED STATES PATENTS

| | | | |
|---|---|---|---|
| 3,015,194 | 2/1962 | Clark | 52/371 |
| 3,172,237 | 3/1965 | Bradley | 52/99 |
| 3,319,384 | 5/1967 | Berg | 52/100 |
| 3,374,590 | 3/1968 | Kessler | 52/464 |
| 3,410,037 | 11/1968 | Empson et al. | 52/470 X |
| 3,411,260 | 11/1968 | Dill | 94/18 |
| 3,792,577 | 7/1965 | Barr | 52/573 X |

*Primary Examiner*—Ernest R. Purser
*Assistant Examiner*—Leslie A. Braun
*Attorney, Agent, or Firm*—Robert F. Hause

[57] ABSTRACT

A thin semi-rigid preformed elongate strip for disposition at the junctions of adjacent drywall wallboards or between sections of a plaster wall to absorb movement within a wall without detrimental effects therefrom, having two outwardly directed opposed flanges arranged for affixation to the wallboard or the lath outer face along adjacent edges, an adjoining central flexible bent portion arranged to be disposed below the general surface plane of the wall between adjacent edges of boards or sections thereof, and adjoined along its lateral edges to the two flanges, and an upwardly extending screed formed in each flange. In the preferred form, a flat strip extends across the central portion on the face of the strip. This may be of different material and more flexible, and may be formed for rapid removal after completion of the wall construction.

1 Claim, 6 Drawing Figures

CONTROL JOINT WITH TEAR STRIP

CROSS REFERENCE TO PATENT APPLICATION

This application is a divisional application, based on application Ser. No. 28,906 filed Apr. 15, 1970, and now abandoned which is a continuation-in-part of application Ser. No. 701,164, filed Jan. 29, 1968, and now abandoned, and this application contains only matter which was in said application Ser. No. 701,164.

BACKGROUND OF THE INVENTION

Control joints for walls and other similar forms of structures have been widely recognized and used heretofore. Prior control joints have been relatively complex. Furthermore, it is not known that any suitable control joint element has been provided for the rapidly expanding drywall system of wall construction.

SUMMARY OF THE INVENTION

The present invention relates to a novel thin flexible preformed elongate strip of a unique and highly simplified cross section, adapted for use as a control joint for absorbing movement within a wall while preventing damage to the wall made therewith. Briefly, the invention is directed to a control joint having two oppositely directed flanges, spaced apart by a flexible bent elongate central web, formed to be disposed between sections of plaster or between edges of wallboards, and a shallow elongate raised screed on each flange, spaced from the central web.

The invention contemplates a unitary control joint further including a flexible face web extending between the two raised screeds which may be easily removed, if desired, after completion of the wall construction.

It is an object of the invention to provide novel means for covering the junctions of wallboard in drywall construction.

It is a further object to provide a novel control joint for use in large expanses of wall to minimize damage from expansion and contraction.

It is a further object to provide a control joint of simplified form and for ease of use in wall construction.

It is a still further object to provide a control joint having a unitary cover web over the expansion - contraction relief portion and to provide such unitary cover web with ready removability.

These and other objects and advantages of the invention will be more readily apparent when considered in relation to the preferred embodiments as set forth in the specification and shown in the drawings in which.

Figure 1:
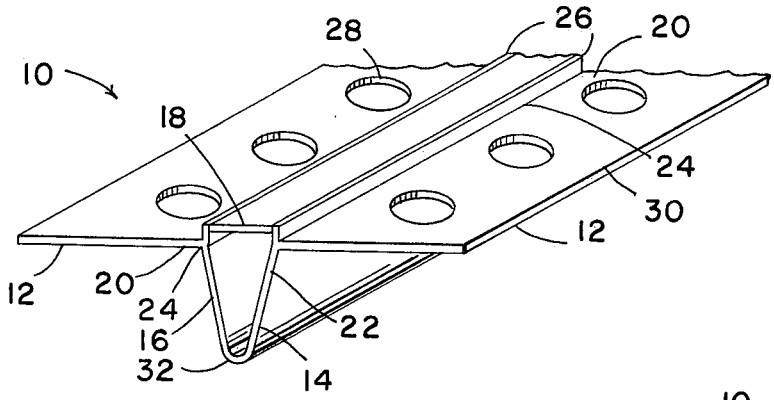
FIG. 1 is a cross-sectional perspective view of an elongate control joint embodying the present invention.

Referring to FIG. 1, there is shown a control joint 10. Control joint 10 is an elongate plastic extrusion having two opposed outwardly extending, semi-rigid flanges 12, 12 and a central expansion - contraction relief portion 14 between the flanges 12, 12. The relief portion includes a permanently-connecting, semi-rigid, folded or U-shaped portion 16, and a temporary, relatively thin, flexible, connecting top web 18. The two flanges 12, 12 are connected at their respective innermost edges 20, 20 to the sidewalls 22, 22 of relief portion 14 at junctions 24, 24 slightly below the upper extent of sidewalls 22, 22, forming, at each side of the relief portion 14, upwardly extending, short screeds 26, 26, The flexible top web 18 is an elongate flat, thin strip extending between the upper edges of the two screeds 26, 26, forming an enclosed hollow interior in the relief portion 14.

All of the structural elements of control joint 10 are of elongate form, being produced by an extrusion process, with the exception of a plurality of quarter inch diameter cement keying holes 28 located approximately every half inch, center to center, along each flange 12, and spaced about a quarter inch away from the flange outer edge 30 and less than a quarter inch away from the flange inner edge 20.

The relief portion 14 is tapered, with a smaller width near the semicircular bottom 32. Bottom 32 has a diameter of about 0.075 inch and sidewalls 22, 22 taper outwardly therefrom to a width of about 0.187 inch between screeds 26, 26. The height of the relief portion 14 from the bottom 32 up to the junctures 24, 24 is preferably equal to the minimum wallboard thickness to be used therewith, or about three-eighths inch. The height of the screeds 26, 26 is determined by the suitable thickness of a cementitious material to be applied thereover, or about 0.062 inch.

The preferred material for the semi-rigid portions of the control joint is a virgin, medium impact, white, rigid polyvinyl chloride, and the thickness of these portions is 0.018 inch, or about two-hundredths of an inch, at which thickness this rigid vinyl, in the relief portion 14, is sufficiently flexible to permit substantial bending of sidewalls 22, 22 toward one another. The flexible web 18 is made from a flexible polyvinyl chloride, of about 0.010 inch thickness, and the two different materials are fused as a part of the process of extruding the two separate materials simultaneously.

The two lines along which the two different materials are fused, the two junctions of the web 18 and the two screeds 26, 26 are lines of relative internal weakness. In the use of the control joint 10 a user may prefer that the web 18 be removed and, by the abovesaid relative weakness, the webs may be readily, completely and neatly torn smoothly away from the screeds, starting at one end of an elongate piece of control joint 10 and pulling the web 18 off of the full length of the piece.

Figure 2:
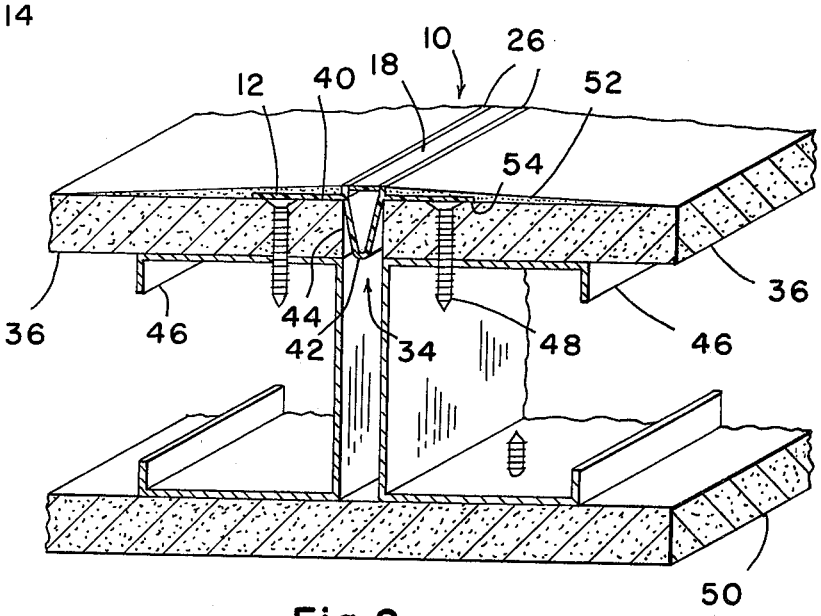
FIG. 2 is a cross-sectional perspective view of a wall with the control joint of FIG. 1 therein.

In FIG. 2 there is shown a cross section of an elongate piece of control junction 10 mounted at a joint 34 between two wallboards 36, 36, with the two respective flanges 12, 12 disposed on the respective wallboard face edges 40, 40 and the relief portion 14 extending into the space 42 which must be provided between the side edges 44, 44 of the two wallboards. In constructing a wall for the use of the control joint 10, which would normally be only a wall having a long unbroken section, such as a corridor wall or a ceiling having over 900 square feet of area, a special wallboard joint 34 using a control joint 10 is located at about every thirty feet of extent of such wall. All other joints or junctions in the wall are normal butt joints, with the usual joint concealing treatment of joint tape and junction cement. This special joint 34, containing the control joint 10, is constructed by mounting the wallboards thereat in suitably spaced relation to permit disposing the relief portion 14 of an elongate control joint 10 between the wallboard side edges 44, 44. The two spaced wallboards 36, 36 are mounted in a manner to permit movement of either board relative to the other board in an amount sufficient to absorb the expansion and contraction of a thirty foot section of wall. Normally this purpose will be accomplished by disposing two studs 46, 46 in spaced relation whereby the edges of the two wallboards 36, 36 are respectively affixed by screws 48, 48 to the separate studs. A wallboard 50, on the opposite side of the partition, is affixed to only one of the two studs 46, 46 to permit greater potential movement of the studs relative to one another.

The control joint 10 is mounted with its flanges 12, 12 affixed to the wallboard face edges 40, 40 by a layer of set cementitious joint cement 52. The joint cement 52 was applied in the form of a settable cementitious slurry and caused to flow through the holes 28 and bond to the wallboard face edges 40 therebelow, and also was formed into a layer of a thickness to provide suitable strength which completely covers the respective flange 12 and extends sufficiently beyond the outer edge of the flange, onto the wallboard to form a strong bond thereto, and to conceal the flange by being tapered to a feather edge and providing a smooth monolithic surface extending from the wallboard surface to the screed 26. The screed 26 is of a height to provide a guide for forming a proper thickness of joint cement 52 on the flange 12.

To assure an essential abutting relationship between the under surface of flanges 12, 12 and wallboard face edges 40, 40, means for holding the flange against the wallboard while applying the joint cement are normally needed. An adhesive 54 may be applied to the flange under surface just prior to mounting the control joint 10. Alternatively, the flanges 12 may be held in place by staples, not shown, inserted therethrough and into the wallboard at about 6 inch spacing, which are merely left there to cooperate with the joint cement 52 which is subsequently applied. Alternatively an adhesive tape, not shown, with adhesive on both faces may be applied throughout the flange under surface prior to forming holes 28, whereby the holes, when formed, will be through both the flange and the tape, the tape being formed with a release paper protecting the tape under surface adhesive until this release paper is removed just prior to mounting the control joint 10.

Figure 3:
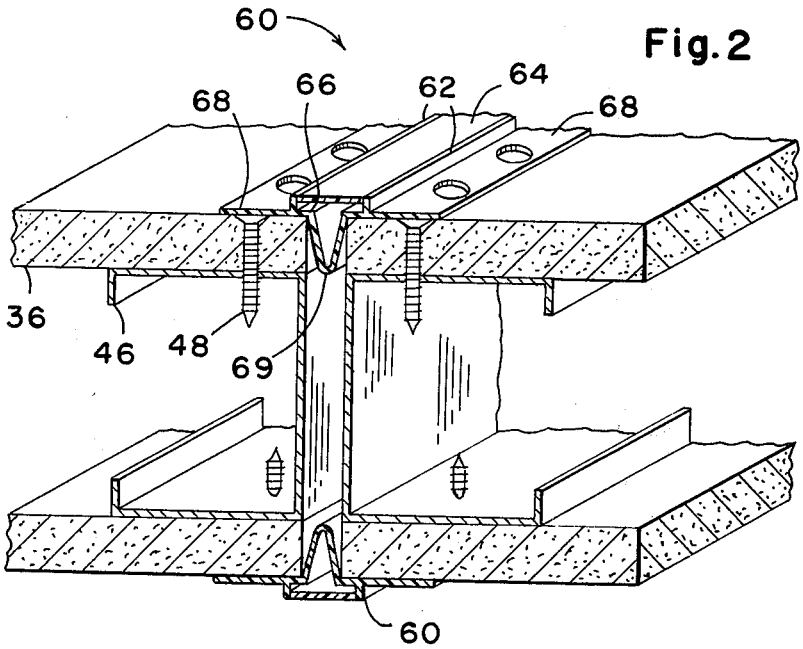
FIG. 3 is a view similar to FIG. 2 of a modified form of control joint, in accordance with the invention.

A modified control joint 60 is shown in FIG. 3, differing from control joint 10, in that screeds 62 are spaced apart wider and flexible web 64 is similarly wider. A shoulder 66 is thus formed inward of each screed 62 disposed in the same plane as the flange 68. After the flexible web 64 is removed, the shoulders 66, 66 provide a place to apply an adhesive cover tape, not shown, to reclose the otherwise exposed groove of the relief portion 69, if such is desired.

Figure 4:
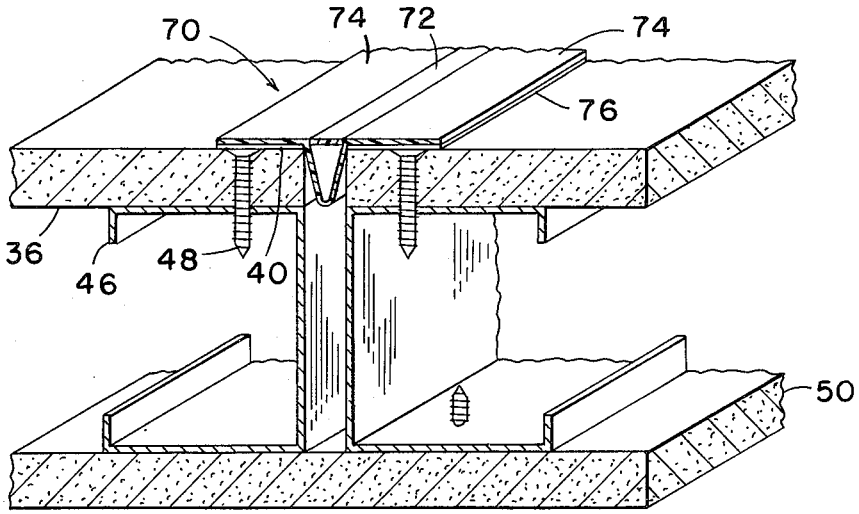
FIG. 4 is a view similar to FIG. 2 with a further modified form of control joint, in accordance with the invention.

A further modified control joint 70 is shown in FIG. 4, wherein the flexible web 72 is formed flush with the two flanges 74, 74 and a smooth top surface is provided thereby. Web 72 is substantially thinner and of a substantially more flexible vinyl chloride than the rest of the control joint 70, and as a result is able to be readily and neatly removed from the rest of the control joint 70, after the control joint 70 is mounted in a wall junction. A tape 76 with adhesive on both sides is disposed under the flanges 74 throughout the under surface, holding the flanges 74 tightly against the wallboard face edges 40, without any other means holding the control joint.

Figure 5:
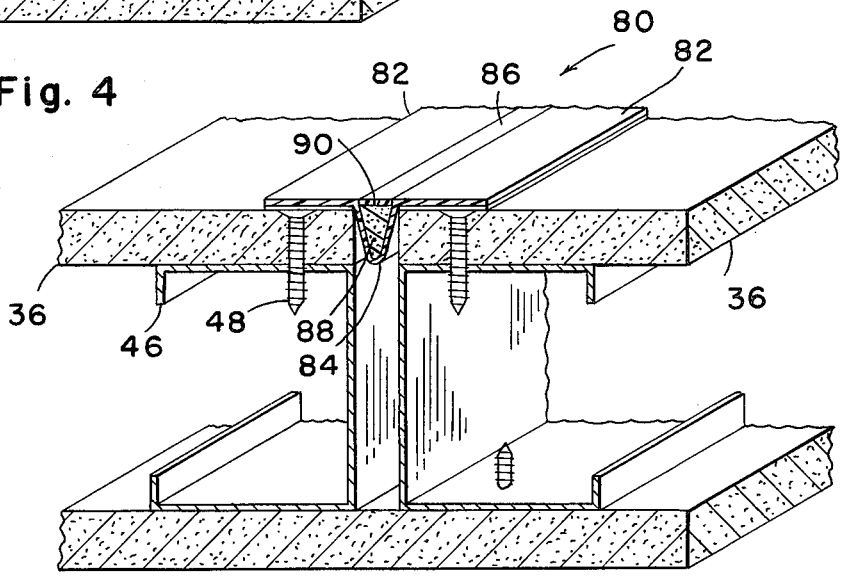
FIG. 5 is a view similar to FIG. 2 with a still further modified form of control joint, in accordance with the invention.

FIG. 5 shows a further modified control joint 80 having an extruded semi-rigid polyvinyl chloride body including flanges 82 and relief portion 84. A web portion 86 of flexible polyvinyl chloride is fused atop the flanges 82 forming, with relief portion 84, a tubular portion filled with a core 88 of flexible foam. The foam core 88 is formed with a flat top surface 90 adhered to the underside of the web 86 whereby the flexible web may suitably be left in place after mounting with substantially less distortion, wrinkling, and sagging occurring in the web as a result of the expansion-contraction movement of the wall.

Figure 6:
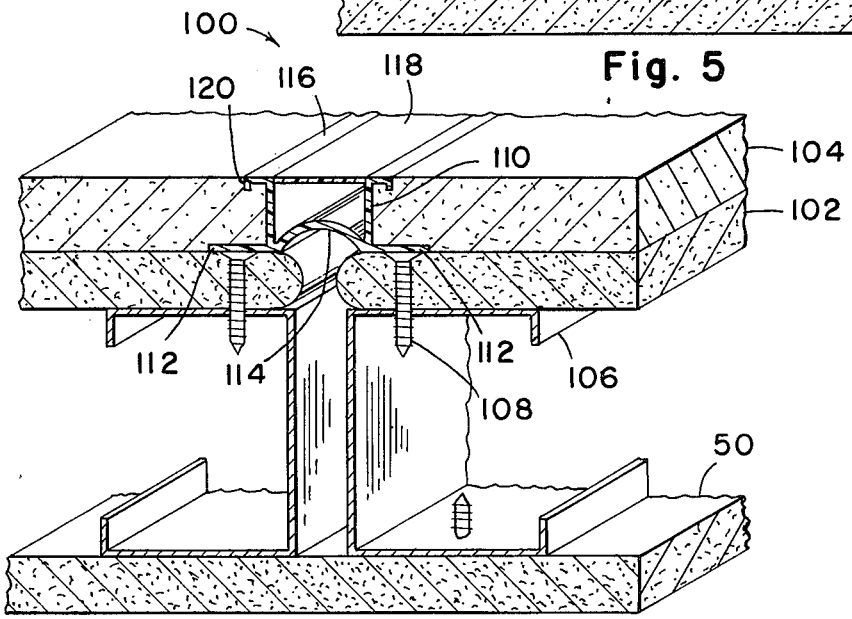
FIG. 6 is a view similar to FIG. 2 of a plaster wall with a modified form of control joint, in accordance with the invention.

FIG. 6 shows a cross section of control joint 100, intended particularly for use in lath and plaster construction. Two sections of plastered wall are shown each including lath sheets 102, plaster 104 which is applied and adhered to lath sheets 102 and screw studs 106 to which lath sheets 102 are attached by screws 108. The control joint 100 includes an extruded semi-rigid polyvinyl chloride body 110 including flanges 112, relief portion 114 and screed portion 116. A web portion 118 of flexible polyvinyl chloride is fused to and extending between the top edges of screed portions 116. Screed include 116 preferably further including an outwardly and downwardly keying flange 120 for improved adherence of the screed portions 116 to the plaster 104.

Having completed a detailed disclosure of the preferred embodiments of our invention, so that others may practice the same, we contemplate that variations may be made without departing from the essence of the invention or the scope of the appended claims.

We claim:

1. In a wall structure including a support and a pair of separate slabs of plaster-like material cast in situ on said support, the combination therewith of a unitary elongated expansible hollow separator between said slabs:

a. said separator having a front wall, a rear wall and opposite side walls;

b. said rear wall including a pair of planar flanges for attaching said separator to said support with said front wall facing outwardly, said flanges respectively extending laterally in opposite directions, said side walls serving as screeds to establish the thickness of said slabs;

c. the center portion of said rear wall being inwardly arched to allow movement of said side walls toward and away from each other in response to expansion and contraction of said separate slabs;

d. said front wall being joined to the side walls by fracture webs of weaker cross-sectional strength than said front wall whereby said front wall forms a tear strip removable after said slabs are formed, said fracture webs being defined by lines of relative structural weakness at the junction of the outer ends of the sidewalls and said front wall, said front wall being substantially flush with said side wall outer edges so that upon removal of said front wall said separator is exposed only at the region of its hollow interior and the screed areas on the outer edges of said side walls; and e. each said side wall being provided with an anchor means extending laterally outwardly from that side wall, the outer end of each anchor being a substantially perpendicularly flanged head locking the side wall to its associated slab for conjoint movement therewith.

* * * * *

UNITED STATES PATENT AND TRADEMARK OFFICE

CERTIFICATE OF CORRECTION

PATENT NO. : 3,964,220

DATED : June 22, 1976

INVENTOR(S) : Edward J. Rutkowski and Gerard T. Sowinski

It is certified that error appears in the above-identified patent and that said Letters Patent are hereby corrected as shown below:

Column 4, line 26, "include" should be ---portions---; same line, "including" should be ---include---.

Signed and Sealed this

Thirty-first Day of August 1976

*Attest:*

RUTH C. MASON
*Attesting Officer*

C. MARSHALL DANN
*Commissioner of Patents and Trademarks*